US006054689A

United States Patent [19]

Imanaka et al.

[11] Patent Number: 6,054,689

[45] Date of Patent: Apr. 25, 2000

[54] PRINTING HEAD AND PRINTING APPARATUS USING SAME

[75] Inventors: Yoshiyuki Imanaka, Yokohama; Tatsuo Furukawa, Isehara; Hiroyuki Maru, Atsugi, all of Japan

[73] Assignee: Canon Kabushiki Kaisha, Tokyo, Japan

[21] Appl. No.: 08/508,905

[22] Filed: Jul. 28, 1995

[30] Foreign Application Priority Data

Jul. 29, 1994 [JP] Japan ..... 6-179212

[51] Int. Cl.[7] ..... H05B 1/02

[52] U.S. Cl. ..... 219/501; 219/501; 219/216 PH; 327/95

[58] Field of Search ..... 347/57, 58, 59; 327/205, 206, 95, 96, 97; 219/483–486, 481, 216 PH

[56] References Cited

U.S. PATENT DOCUMENTS

| | | | |
|---|---|---|---|
| 4,313,124 | 1/1982 | Hara | 346/140 R |
| 4,345,262 | 8/1982 | Shirato et al. | 346/140 R |
| 4,459,600 | 7/1984 | Sato et al. | 346/140 R |
| 4,463,359 | 7/1984 | Ayata et al. | 346/1.1 |
| 4,558,333 | 12/1985 | Sugitani et al. | 346/140 R |
| 4,608,577 | 8/1986 | Hori | 346/140 R |
| 4,649,401 | 3/1987 | Kojima et al. | 346/76 PH |
| 4,723,129 | 2/1988 | Endo et al. | 346/1.1 |
| 4,740,796 | 4/1988 | Endo et al. | 346/1.1 |
| 5,051,756 | 9/1991 | Nomura et al. | 346/76 PH |
| 5,083,137 | 1/1992 | Badyal et al. | 346/1.1 |
| 5,307,093 | 4/1994 | Suzuki et al. | 346/1.1 |
| 5,327,020 | 7/1994 | Ikeda | 307/290 |
| 5,504,505 | 4/1996 | Tamura et al. | 347/13 |
| 5,514,987 | 5/1996 | Ramirez | 327/74 |

FOREIGN PATENT DOCUMENTS

| | | |
|---|---|---|
| 0641655 | 3/1995 | European Pat. Off. . |
| 54-51837 | 4/1979 | Japan . |
| 54-56847 | 5/1979 | Japan . |
| 56-136033 | 10/1981 | Japan . |
| 58-056519 | 4/1983 | Japan . |
| 59-022443 | 2/1984 | Japan . |
| 59-123670 | 7/1984 | Japan . |
| 59-138461 | 8/1984 | Japan . |
| 60-71260 | 4/1985 | Japan . |
| 4-81118 | 3/1992 | Japan . |
| 2843064 | 4/1979 | United Kingdom . |

*Primary Examiner*—Mark Paschall

*Attorney, Agent, or Firm*—Fitzpatrick, Cella, Harper & Scinto

[57] ABSTRACT

Heating elements and logic circuits are provided on the base board of a printing head, and noise inhibiting circuit having a hysteresis characteristic are provided between the logic circuits and the input terminals of the base board. The base board, heating elements, logic circuits and noise inhibiting circuits are fabricated by a semiconductor manufacturing process. Each noise inhibiting circuit applies an input signal that enters from an input pad to first and second gates constituted by two MOSFETs having threshold potentials that differ from each other. A flip-flop circuit set or rest by the outputs of the first and second gates is provided on the output side. The noise inhibiting circuit having the hysteresis characteristic is constructed between the threshold potential of the first gate and the threshold potential of the second gate.

41 Claims, 11 Drawing Sheets

PRINTING HEAD AND PRINTING APPARATUS USING SAME

BACKGROUND OF THE INVENTION

1. Field of the Invention

This invention relates to a printing head having a plurality of recording elements (e.g., in ink-jet nozzles, heating elements, wires, etc.), ink jet cartridge, and to a printing apparatus employing such a printing head.

2. Description of the Related Art

A printing apparatus using an ink-jet printing head has become the focus of much interest not only because the noise produced at the time of printing is so small as to be negligible but also because of the high printing speed and the ability to print on plain paper. Among such printing methods available, an ink-jet printing method described in Japanese Patent Application Laid-Open (KOKAI) No. 54-51837 and German Patent Application Laid-Open (Dols) No. 2843064 differs from the others in that thermal energy is made to act upon ink to obtain a motive force for discharging a drop of the ink. More specifically, the printing method disclosed in these publications produces a change in state accompanying a sudden increase in the volume of ink acted upon by thermal energy, and discharges the ink from an orifice at the tip of a printing head by a working force based upon the change in state, thereby forming a jetted drop of ink. The ink drop attaches itself to a printing medium to perform printing.

The ink-jet printing method described in German Patent Application Laid-Open (Dols) No. 2843064 not only is effectively applicable to a so-called drop-on-demand printing method but, since it is of the full-line type, the method also readily lends itself to a printing head in which multiple orifices are provided in high density. Using such a printing head makes it possible to obtain a high-resolution, high-quality image at high speed.

The printing head of the apparatus applied to this method comprises an ink discharge section and an element base board. The ink discharge section has orifices provided so as to discharge the ink, and ink passageways communicating with the orifices and having a heat applying section for subjecting the ink to thermal energy in order to discharge the ink. The element base board has electrothermal transducers (heating elements) which generate thermal energy.

By virtue of technological advances made in recent years, the base board is no longer merely composed of a plurality of heating elements on a substrate. Now a driver for driving the individual heating elements, a shift register for holding serially entered image data, converting the data to parallel data and outputting the data, and a latch circuit for temporarily storing the data outputted by the shift register can all be constructed on the same element base board.

FIG. 5 shows an example of the circuitry of the base board constructing the conventional printing head. Specifically, FIG. 5 illustrates an element base board 600, heating elements 601, power transistors 602 constructing a driver circuit, a latch circuit 603, a shift register 604 and input pads 605 611, namely a pad 605 for inputting a clock signal, which is a synchronizing signal for image data that enters from pad 606, a pad 607 for entering a latch signal, a pad 608 for entering a drive pulse (strobe signal) to externally control the ON time of the power transistors 602, namely the time during which current is passed through the heating elements 601 to drive them, a pad 609 connected to a power supply (5 V) for driving logic circuits, a pad 610 for ground (GND) and a pad 611 connected to a power supply for driving the heating elements.

According to the driving sequence of the printing head having this construction, first image data from the printing apparatus proper is synchronized to the clock and outputted to the element base board 600 serially. This image data is held in the shift register 604 and is temporarily stored in the latch circuit 603 in sync with the latch signal. As a result, ON, OFF outputs conforming to the image data are latched. When heating pulses are applied under these conditions, a power transistor which corresponds to ON ("1") image data in the latch circuit 603 is turned on for the duration of the high-level heat pulse and a current flows into the heating Element 601 connected to this power transistor, whereby the heating element is driven to produce heat.

Further, the ink-jet printing head is attached and detached by the user for reasons such as replacement of an ink cartridge. If the printing head is not attached properly and the electrical contact between the ink-jet head and printing apparatus proper is insufficient as a result, the printing head may be driven abnormally and may even be destroyed. Accordingly, it is designed for signal Lines inputted to and outputted from the element base board to be provided with pull-up or pull-down resistors in order to avoid these problems.

As described above, logic circuits such as the shift register 604, heating elements and the power transistors 602 are formed on the element base board 600. However, a problem encountered is that when a plurality of the heating elements 601 are driven simultaneously, a sudden fluctuation in current occurs and happens to cause a fluctuation in the voltage of the clock and the generation of noise, as a result of which the logic circuits provided on the element base board malfunction.

SUMMARY OF THE INVENTION

Accordingly, an object of the present invention is to provide a printing head in which malfunction due a noise component contained in a signal applied to the head is prevented, as well as a printing apparatus which uses this printing head.

Another object of the present invention is to provide a printing head in which operation of the printing head is not affected and is prevented from operating erroneously depending on a noise signal included in an input signal, even if poor contact results from improper mounting of the head, as well as a printing apparatus which uses this printing head.

Another object of the present invention is to provide a printing head in which a circuit having a hysteresis characteristic can be formed in a simple manner by a MOS-type semiconductor manufacturing process, as well as a printing apparatus which uses this printing head.

Still another object of the present invention is to provide a printing head in which operation of the printing head is not affected even there is a fluctuation in the signal level of an input signal, as well as a printing apparatus which uses this printing head.

According to the present invention, the foregoing objects are attained by providing an element base board provided with a plurality of heating elements and circuits for driving the plurality of heating elements in conformity with image data, the base board comprising a plurality of signal input terminals, and an input-signal processing circuit, having a hysteresis characteristic, provided between each of the plurality of signal input terminals and each of the circuits.

Further, according to the present invention, the foregoing objects are attained by providing a printing apparatus for printing on a recording medium by passing a current into a printing head in conformity with a print signal, comprising a printing head having a base board provided with a plurality of heating elements and circuits for driving the plurality of heating elements in conformity with image data, wherein the base board includes a signal input terminal and an input-signal processing circuit, having a hysteresis characteristic, provided between the signal input terminal and the circuit, and printing means for performing printing by outputting the image data to the printing head and driving the plurality of heating elements in conformity with the image data.

Other features and advantages of the present invention will be apparent from the following description taken in conjunction with the accompanying drawings, in which like reference characters designate the same or similar parts throughout the figures thereof.

DESCRIPTION OF THE PREFERRED EMBODIMENTS

Preferred embodiments of the present invention will now be described in detail with reference to the accompanying drawings. The construction of an ink-jet printing apparatus according to an embodiment will be described first with reference to FIGS. 2–3, and 5.

Figure 2A:
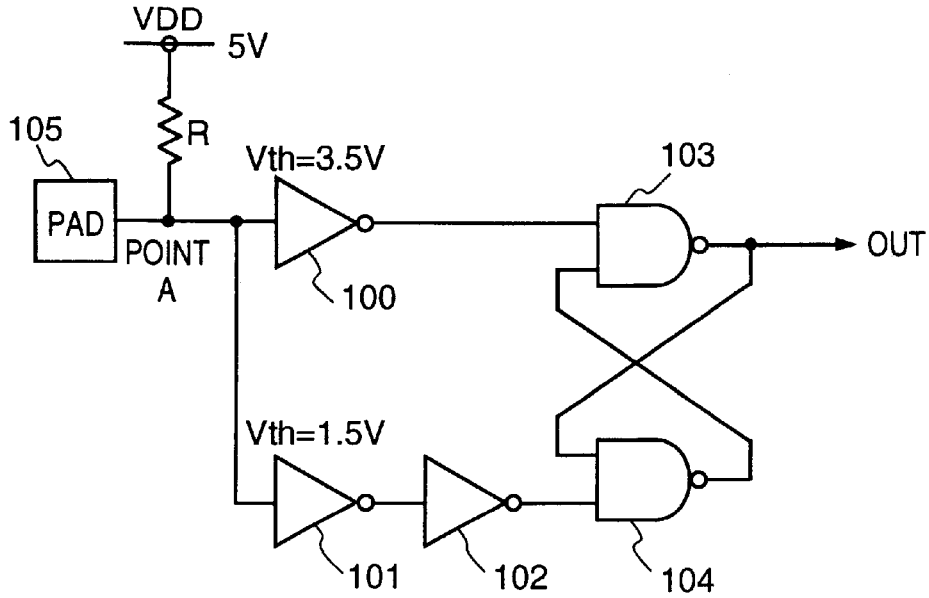
FIG. 2A is a diagram showing the construction of a signal input circuit on the base of a printing head according to an embodiment of the present invention.
Figure 2B:
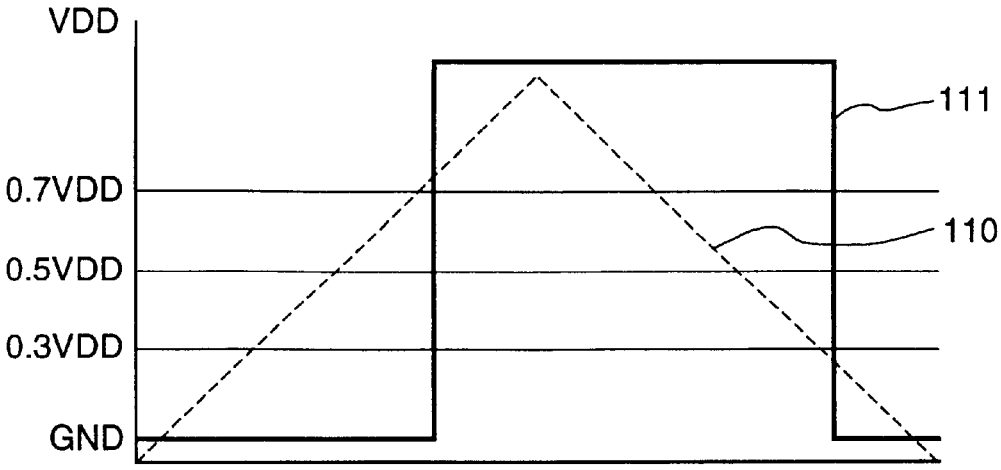
FIG. 2B is a diagram showing a hysteresis characteristic of this circuit.
Figure 3:
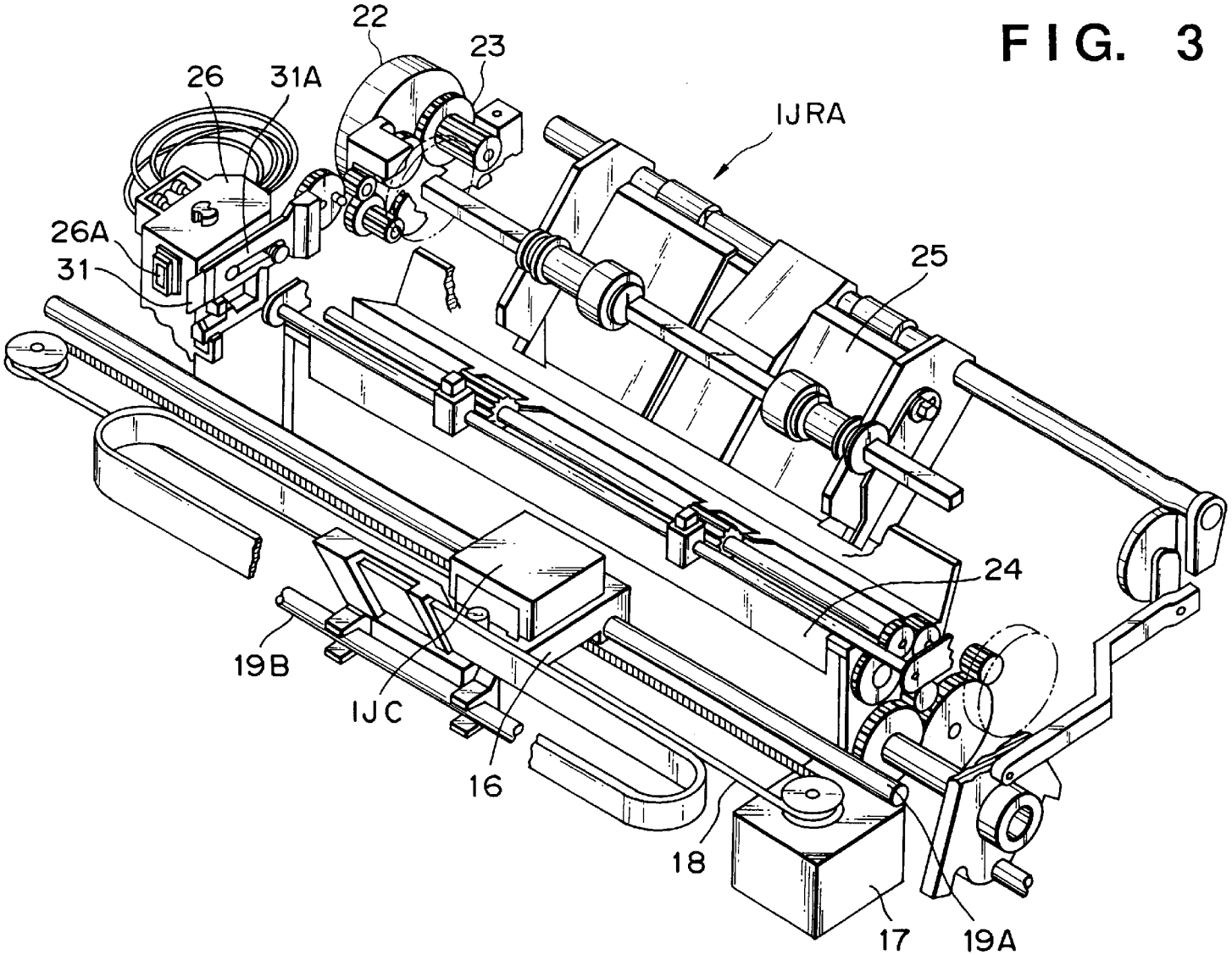
FIG. 3 is a perspective view showing the external appearance of the printing section of an ink-jet printing apparatus according to an embodiment of the invention.

As shown in FIGS. 2 and 3, an ink-jet cartridge IJC is capable of being attached to and detached from a carriage 16 of an ink-jet printing apparatus IJRA of this embodiment by a prescribed method. The ink-jet cartridge IJC (FIG. 4), more than one of which can be provided in dependence upon the inks used, has an ink-jet printing head portion 200 shown in FIG. 5, an ink tank (or ink container) 400 and an ink sensor for sensing the amount of ink remaining in the ink tank.

Figure 4:
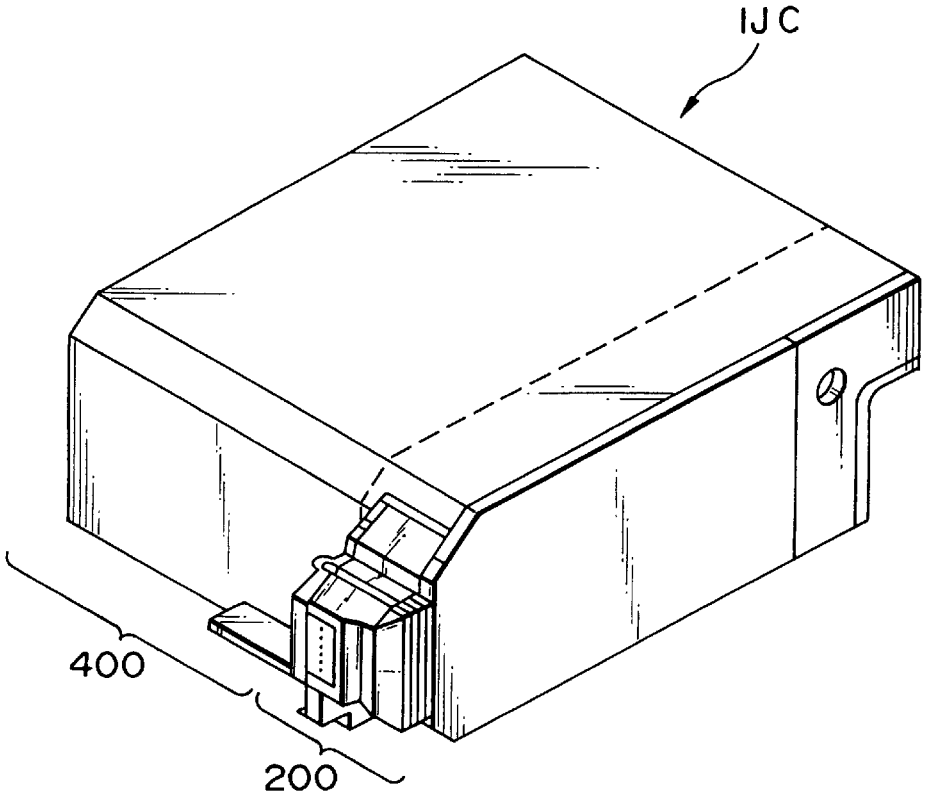
FIG. 4 is a perspective view showing an ink jet cartridge of an ink jet printing head according to the embodiment.

FIG. 4 shows a main portion (printing head 300) of the ink—et cartridge. The printing head 300 is supplied with an ink discharge signal, which conforms to print data, from a data supply source via a cable and a terminal connected to the cable. The printing head 300 includes an element base board (heater board) 330 having a plurality of heating elements and a plate 302, provided with partitioning walls for forming flow passageways 305 connected with ink discharge ports 304. The plate 302 consists of a resin exhibiting excellent resistance to ink. Examples of such resins are polysulfone, polyether sulfone, polyphenylene oxide and polypropylene. The ink tank 400 stores ink supplied to the printing head 300 and is constituted by an ink suction unit, a vessel for inserting the ink suction unit and a cover member for sealing the vessel. None of these components are shown. Ink stored in the ink tank 400 is supplied to the printing head 300 in successive fashion via an ink supply passage 303 in dependence upon the amount of ink discharged from ink discharge ports 304.

With reference again to FIG. 3, the carriage 16 is coupled to part of a drive belt 18 which transmits the driving force of a drive motor 17 so that the carriage 16 can be slid along two parallel guide shafts 19A, 19B, thereby raking it possible to reciprocate the printing head 300 across the full width of a printing medium (recording paper). Relative movement between the carriage 16 and the printing medium is controlled by input of a prescribed printing signal, whereby a desired printed image is formed on the printing surface of the recording paper fed from a paper supply unit 25 to a platen 24 which is a convey means.

A head recovery unit 26 is provided at one end of the traveling path of the printing head 300, such as at a position confronting the home position. The head recovery unit 26 is operated by driving force provided by a motor 22 via a motor mechanism 23 and functions to cap the printing head 300. In operative association with the capping of the printing head 300 by a cap portion 26A of the head recovery unit 26, ink is drawn in by suction means provided within the head recovery unit 26 or ink is forcibly expelled from the ink discharge ports by pressurizing means provided in the ink supply path to the printing head 300, whereby a discharge recovery treatment for removing viscous ink from the interior of the flow passages is carried out. By capping the printing head 300 at the conclusion of printing, the head 300 is protected and is prevented from drying out.

A blade 31 is disposed at the side of the head recovery unit 26 and comprises a wiping member consisting of silicone rubber. The blade 31 is held by a blade retaining member 31A in cantilevered fashion and is actuated by the motor 22 and motor mechanism 23 in the same manner as the head recovery unit 26 so as to be capable of engaging the discharge surface of the printing head 300. As a result, the blade 31 is projected into the path of movement of the printing head 300 at a suitable timing during the printing operation of the printing head 300 or at the time of discharge recovery using the head recovery unit 26. Thus, as the printing head 300 moves, the blade 31 wipes the discharge surface of the printing head 300 to remove condensation, moisture and dust.

Figure 5:
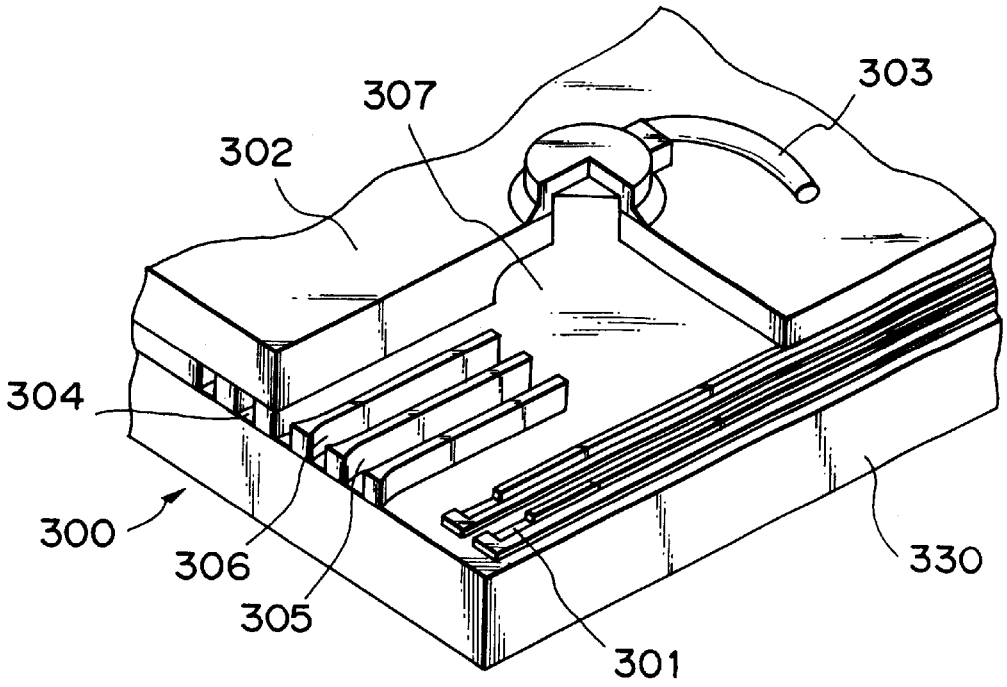
FIG. 5 is a perspective view and a partial cross section showing the construction of an element head portion of a printing head according to this embodiment.

FIG. 5 is a perspective view and a partial cross section showing the construction a main portion of the printing head 300 according to this embodiment. As described above, the ink-jet printing head 300 is formed by attaching flow-path wall members 306, which form the flow passageways 305 communicating to a plurality of discharge ports 304, and the grooved member 302 having the ink supply passage 303. In this case, the ink supplied from the ink supply passage 303 temporarily accumulates in a common liquid chamber 307 within the head and is supplied to each of the flow passageways 305. By supplying current to the heating element 301 on the element base board 330 under these conditions, ink is discharged from the discharge ports 304.

Figure 1:
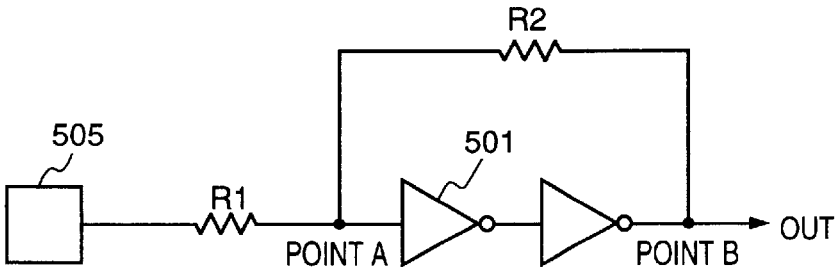
FIG. 1 is a diagram showing the construction of a circuit for realizing a hysteresis characteristic according to a present embodiment.

FIG. 1 shows an equivalent circuit of a hysteresis circuit using potential (voltage) dividing resistors, which are formed on an element base board by using a manufacturing process of a semiconductor as well as forming switching transistors and logic circuits as shift registers and the like.

In FIG. 1, 505 represents an input pad for receiving an electrical signal supplied with an element base board from an external device. The hysteresis circuit is provided between the pad 505 and the logic circuit. Resistors R1 and R2 are potential dividing resistors which divide the potential at a point A and provide the hysteresis characteristics, i.e. changing threshold value of the input at rise time and decay time.

When the circuit is provided on the element base board, a printing head in which operation of the printing head is not affected and is prevented from operating erroneously depending on a noise signal, even if most of heating elements on the board are simultaneously driven. The description of the principle for preventing erroneous operation based on the hysteresis characteristics are described later with reference to FIG. 2B.

Further, the hysteresis circuit is integrated into the element base board having logic circuits as shift register and latch circuit. It is possible to minimize the size of the printing head and to simplify the processing of manufacturing a printing head.

According to the above-described embodiment, in order to prevent erroneous operation caused by a noise signal, the hysteresis circuit is integrated into the element base board. The inventors of the present application have studied to manufacture the element base board of a printing head in which a circuit is integrated. The element base board can not only protect erroneous operation caused by a noise signal, but also can protect the destruction or runaway of the base board caused by a poor contact of the printing head.

Figure 6:
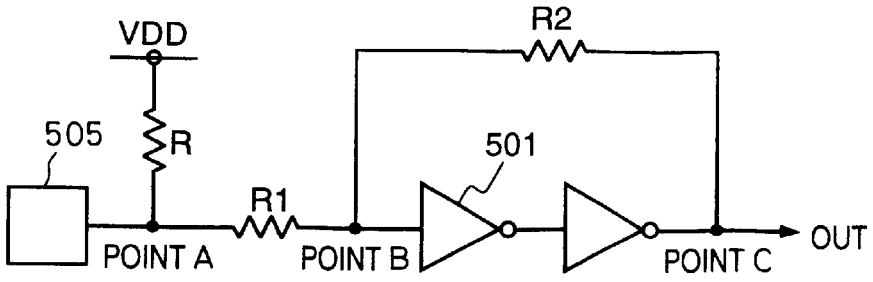
FIG. 6 is a diagram describing the related art showing a pull-up circuit and a circuit realizing hysteresis characteristics.

FIG. 6 is an equivalent circuit diagram in which a hysteresis circuit based upon potential division by resistors and a pull-up resistor are simultaneously introduced between the input pad 505 and logic circuits on the element base board of the printing head.

However, if the circuit shown in FIG. 6 is adopted, interfere described later with each other circuit can be found. How the hysteresis circuit and the pull-up resistor interfere with each other will now be described in simple terms. In FIG. 6, R represents a pull-up resistor. If the ink-jet printing head is not attached properly, a signal applied to the pad in FIG. 4 tends to "float" or attain a high impedance. The pull-up resistor R is for the purpose of establishing a logic level (a high level, since this is a pull-up resistor) to prevent runaway and destruction. Resistors $R_1$, $R_2$ are potential-dividing resistors which divide the potential at a point B to change the threshold value of the input at rise time and decay time, as described above. The voltage-dividing resistance values will be considered for a case where, by way of example, the resistance value of the pull-up resistor R is 100 KΩ and the ratio of the resistance value of $R_1$ to that of $R_2$ is 1:2.5 (where the threshold value is 0.7 $V_{DD}$ at rise time and 0.3 $V_{DD}$ at decay time). When the potential of the pad floats in a case where the potential at point C is at the low level (O V), the potential at the output point (point C) must be raised to the high level by the pull-up resistor R. To accomplish this, the potential at point B must be made higher than the threshold value (usually 2.5 V) of an inverter 501. Since the potential at point B is represented by $[(R+R_1)\times V_{DD}/(R+R_1+R_2)]$, it is required that the resistance value of the resistor $R_1$ be made more than 14 times (or a value greater than 1400 KΩ, for example) the resistance value of the pull-up resistor R from the threshold-value margin in order to make the input of the inverter 501 greater than the input threshold value of the inverter 501. Furthermore, the resistance value of the resistor $R_2$ becomes 2.5 times (or 3500 KΩ, for example) the resistance value of the resistor $R_1$. However, a resistor having such a high resistance value is difficult to manufacture in a semiconductor manufacturing process to a high precision.

In a case where the above-mentioned resistors are provided on the element base board of the printing head to simultaneously attain the foregoing two objectives, namely the elimination of noise by hysteresis based upon voltage division by means of resistors and the introduction of pull-up or pull-down resistors as a fail-safe expedient when contact is poor, the resistors interfere with each other. More specifically, since the pull-up and pull-down resistors directly affect input impedance, resistance values on the order of several tens of kilohms to several hundred kilohms are required in view of power consumption and ability to drive the element base board of the printing head. In order to reduce the effect of the voltage dividing resistors on the input impedance in such case, the resistance values of the voltage dividing resistors must be enlarged to several megohms. Providing a plurality of such high-precision resistors is a considerable burden in terms of manufacture and invites an increase in manufacturing cost.

FIG. 2A is a diagram showing an example in which a pull-up resistor and a hysteresis circuit are simultaneously introduced into the base board of a printing head according to this embodiment. By way of example, the circuit is provided between each input pad of the printing-head base board in the related art (FIG. 6) and the circuitry such as the AND gates, shift register 604 and latch circuit 603.

The arrangement of FIG. 2A includes a MOS inverter 100 having a threshold value of 3.5 V (=0.7×$V_{DD}$, where $V_{DD}$=5 V), a MOS inverter 101 having a threshold value of 1.5 V (=0.3×$V_{DD}$), an ordinary inverter circuit 102 having a threshold value of 2.5 V (=0.5×$V_{DD}$), NAND gates 103, 104 and an input pad 105.

The input/output characteristic of this circuit is as shown in FIG. 2B. When a signal indicated at 110 in FIG. 2B enters at the pad 105, a flop-flop constructed by the NAND gates 103, 104 is initially reset so that the output signal (OUT) assumes the low level. When the output of the inverter 100 falls to the low level at the moment the input signal 110 exceeds 0.7 $V_{DD}$ (=3.5 V), the output of the NAND gate 103 attains the high level and so does the output (OUT). Next, when the potential of the input signal 110 declines, the output of the inverter 101 is inverted at the moment this potential falls below 0.3 $V_{DD}$ (=1.5 V). Thus the output of the inverter 101 rises to the high level and so does the output of NAND gate 104, as a result of which the output signal (OUT) falls to the low level. The waveform of the output signal (OUT) is shown at 111 in FIG. 2B.

Thus, the circuit shown in FIG. 2A has a hysteresis characteristic, in which the threshold value is 0.7 $V_{DD}$ at rise time and 0.3 $V_{DD}$ at decay time. As a result, the circuit is strongly resistant to noise. In addition, since the inverters 100, 101 are MOS inverters, the input impedance thereof is substantially infinite with respect to the pull-up resistor R. Therefore, the potential at point A in FIG. 2A becomes sufficiently near $V_{DD}$ if the potential of pad 105 floats. As a result, there is no influence from the voltage-dividing resistance of the hysteresis circuit, as occurs in the prior art. When the potential of pad 105 floats, the output (OUT) can be raised to the high level with assurance.

The circuit arrangement for changing the threshold values of the inverters 100, 101 in FIG. 2A will now be described.

Figure 7:
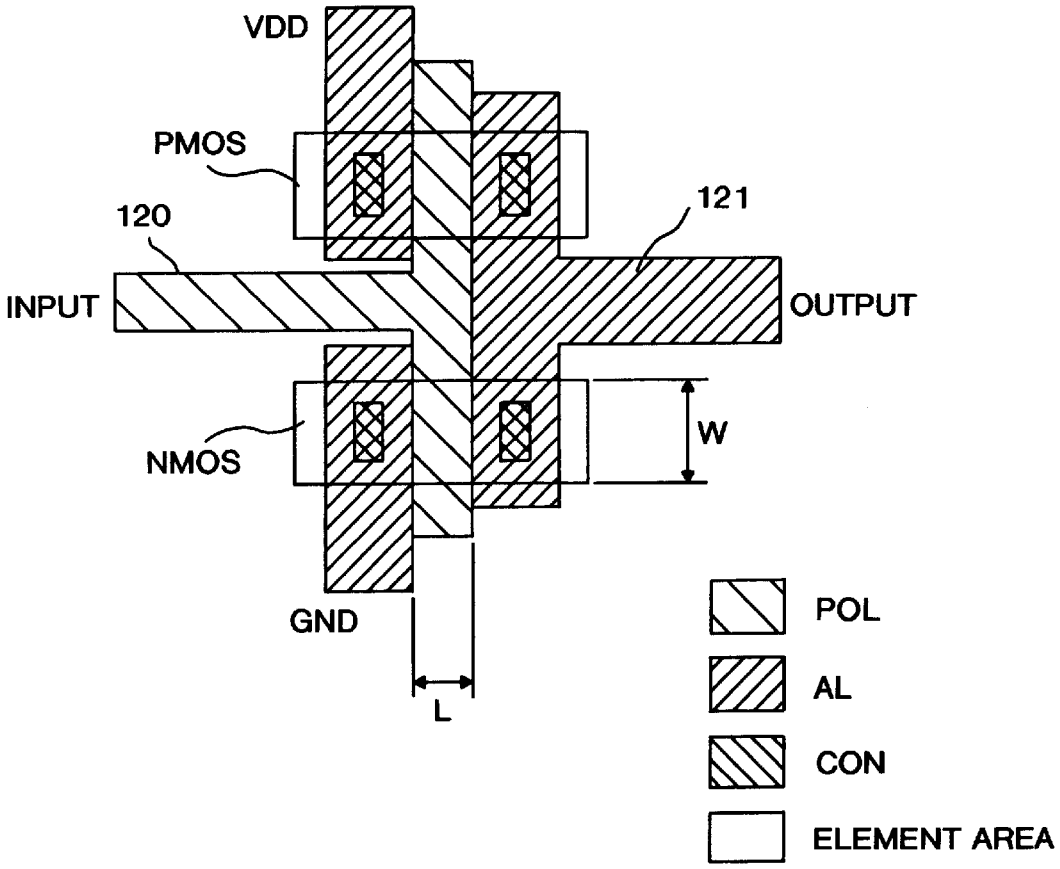
FIG. 7 is a diagram showing the composition of a MOS inverter on the base of the printing head according to this embodiment.

FIG. 7 is a diagram illustrating an example of a MOS inverter, in which L and W indicate the length and width, respectively, of a MOSFET. Numeral 120 denotes an input signal line from the input pad 105, and numeral 121 designates an output signal (OUT) line.

Figure 8A:
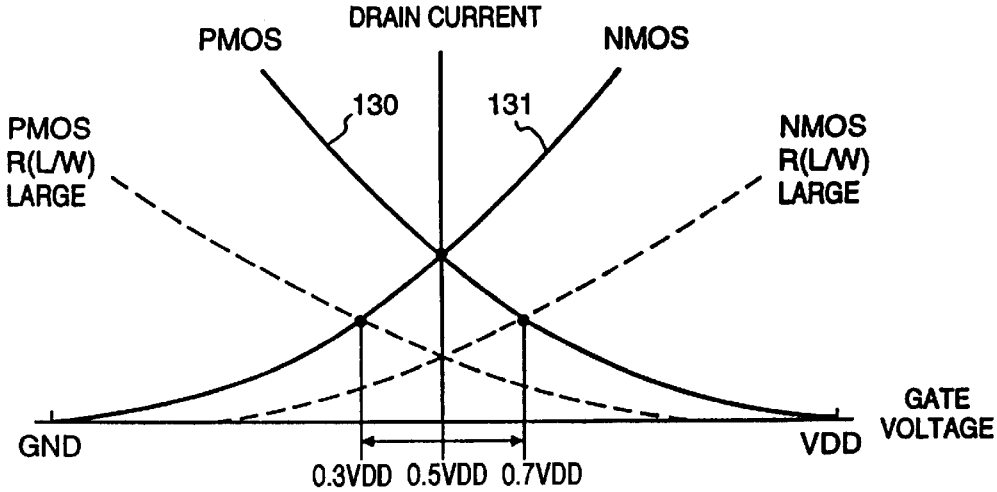
FIGS. 8A and 8B together are a diagram illustrating the input/output characteristic and hysteresis characteristic of an inverter used on the base of the printing head according to this embodiment.
Figure 8B:
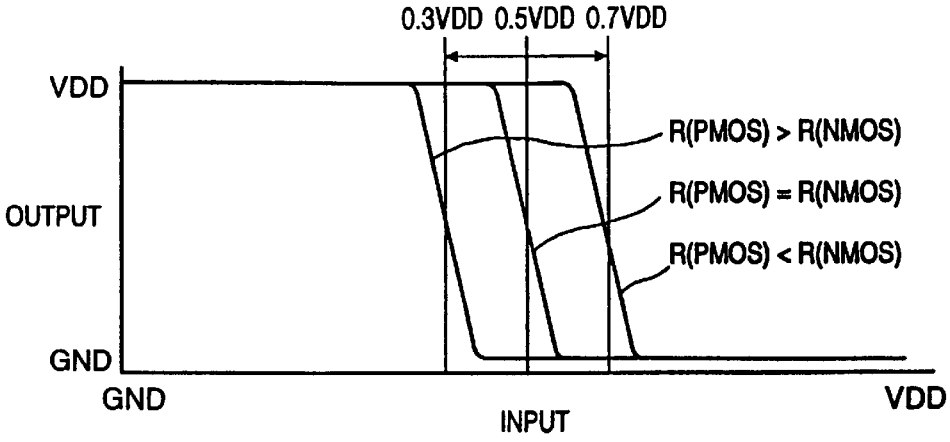

FIGS. 8A and 8B illustrate a characteristic in which the gate voltages of an NMOS and a PMOS are plotted against the drain current which flows at such time, as well as the hysteresis characteristic that accompanies this characteristic.

Ordinarily, a MOS inverter is constructed in such a manner that the channel resistances of the PMOS and NMOS portions are made approximately the same, as indicated by the solid lines 130, 131, so that the threshold value becomes 0.5 $V_{DD}$ at the center. Channel resistance can be increased or decreased by changing [L (length)/W (width)] of the gate in FIG. 7. Accordingly, L and W are set with regard to the inverter 100 of FIG. 2A so as to establish the relation channel resistance (NMOS)>channel resistance (PMOS)

and with regard to the inverter 101 so as to establish the relation channel resistance (NMOS)<channel resistance (PMOS).

As a result, as indicated by the hysteresis characteristic of FIGS. 8A and 8B, inverter circuits having different threshold values from each other can be formed on the same printing head base by the process used to manufacture an ordinary logic circuit.

The operation of a hysteresis circuit thus constructed using inverters having two different threshold values will now be described with reference to FIGS. 9 through 12.

Figure 9:
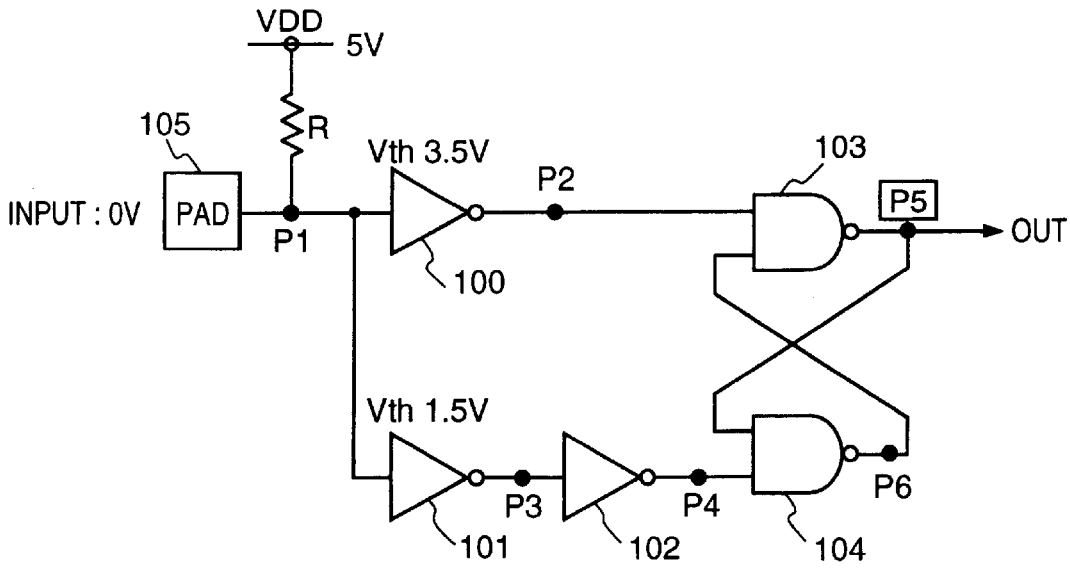
FIG. 9 is a diagram for describing the operation of a signal input circuit according to an embodiment.
Figure 10:
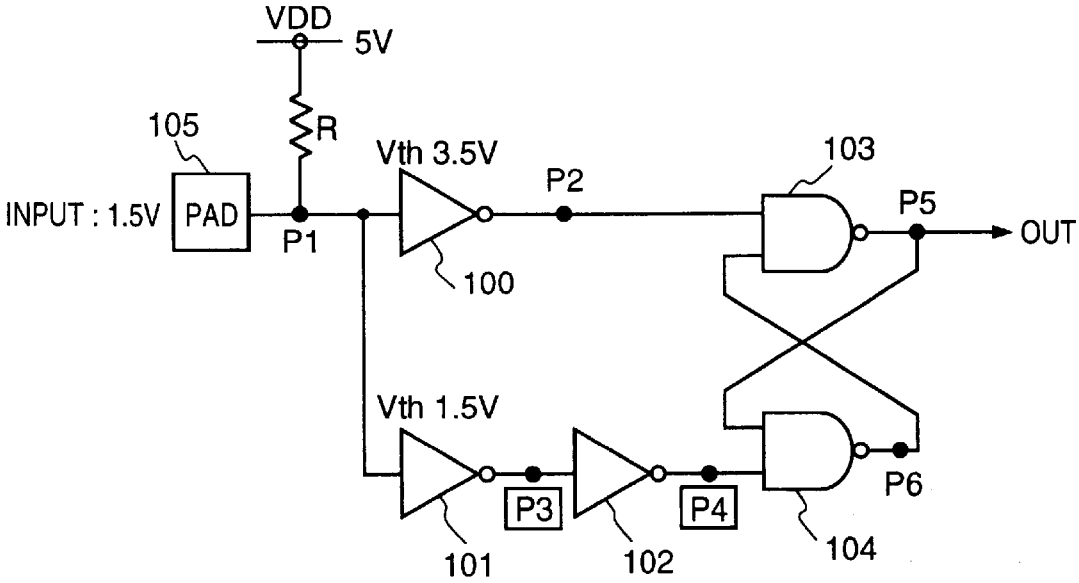
FIG. 10 is a diagram for describing the operation of the signal input circuit according to an embodiment.

FIG. 9 illustrates a situation in which 0 V is being applied from the input pad 105. The points P1~P6 indicated by the black circles in FIGS. 9~12 represent the voltages or logic levels at the respective points. FIG. 10 shows a case in which the potential at the input pad 105 has changed from 0 V to 1.5 V. Since the threshold value of the input signal to the inverter 101 is 1.5 V, the potential at point P3 changes from the high level to the low level and the potential at point P4 changes from the low level to the high level.

Figure 11:
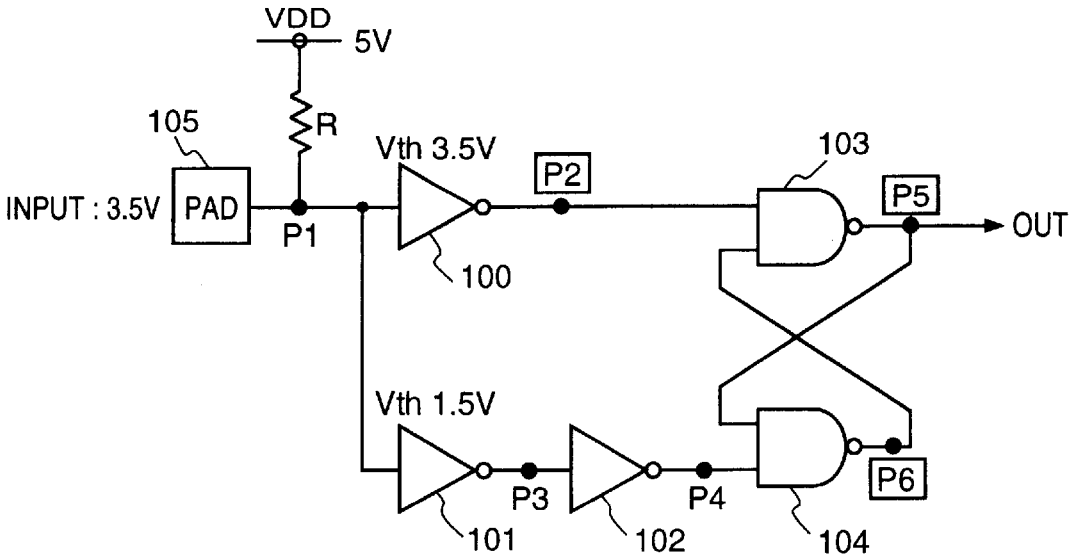
FIG. 11 is a diagram for describing the operation of the signal input circuit according to an embodiment.
Figure 12:
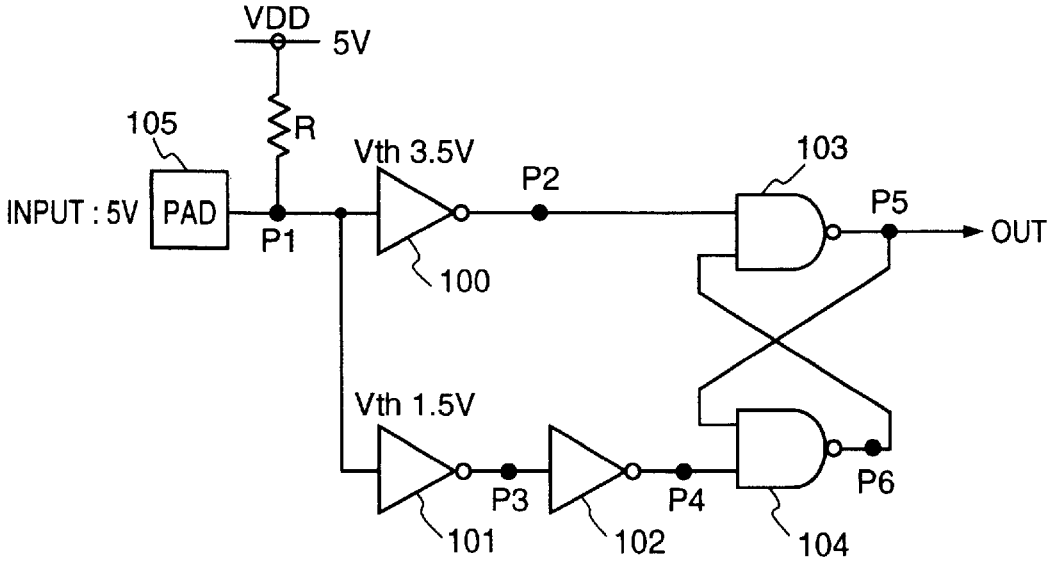
FIG. 12 is a diagram for describing the operation of the signal input circuit according to an embodiment.

FIG. 11 illustrates a case in which the signal level at the input pad 105 has changed from 1.5 V to 3.5 V. Since the input threshold value of the inverter 100 is 3.5 V, the output of the inverter 100 is inverted and the potential at point P2 assumes the low level. As a result, the potential level of the output (P5) of NAND gate 103 is inverted and rises to the high level. It may thus be understood that the signal potential of the input pad 105 becomes 3.5 V and that the output (OUT) rises to the high level. Even if the potential of the input pad 105 rises further to 5 V, the level of the output signal is maintained and remains at the high level, as shown in FIG. 12. Further, even if the potential at the input pad 105 assumes the floating state, the potential at point P1 is maintained at 5 V.

Next, in a case where the potential at the input pad 105 falls from 5 V to 0 V, the inverter 100 whose input threshold value is 3.5 $V_{DD}$ is inverted earlier than the inverter 101 at the moment the potential at point P1 attains the value of 3.5 V. In this case, the potential at point P6 is at the low level, however, and therefore the output (OUT) is unaffected. When the potential at the input pad 105 falls to 1.5 $V_{DD}$, the inverter 101 is inverted, its output attains the high level (point P3), the potential at point P4 falls to the low level, the potential at point P6 rises to the high level and the output (OUT) changes to the low level.

Thus, the input-signal processing circuit on the base of the printing head is provided with a hysteresis characteristic. As a result, when the input signal is at the low level (0 V), the output is not inverted until the level rises to 3.5 V. When the input signal is at the high level (greater than 3.5 V), the output is not inverted until the input signal level falls below 1.5 V. Thus, it is possible to obtain a hysteresis characteristic having an improved noise margin.

According to this embodiment, the description is based upon use of a pull-up resistor. However, it goes without saying that the same effects are obtained if a pull-down resistor is used.

Further, a circuit arrangement in which a plurality of inverters having different threshold values are prepared and the outputs thereof are suitably selected to attain the object of this embodiment is not limited to the circuit of this embodiment.

By installing the printing head 300 having the above-described printing head base in a printing apparatus and providing the printing head 300 with a print signal from the printing apparatus, resistance to noise can be improved and printing having a high image quality can be performed at high speed.

Figure 13:
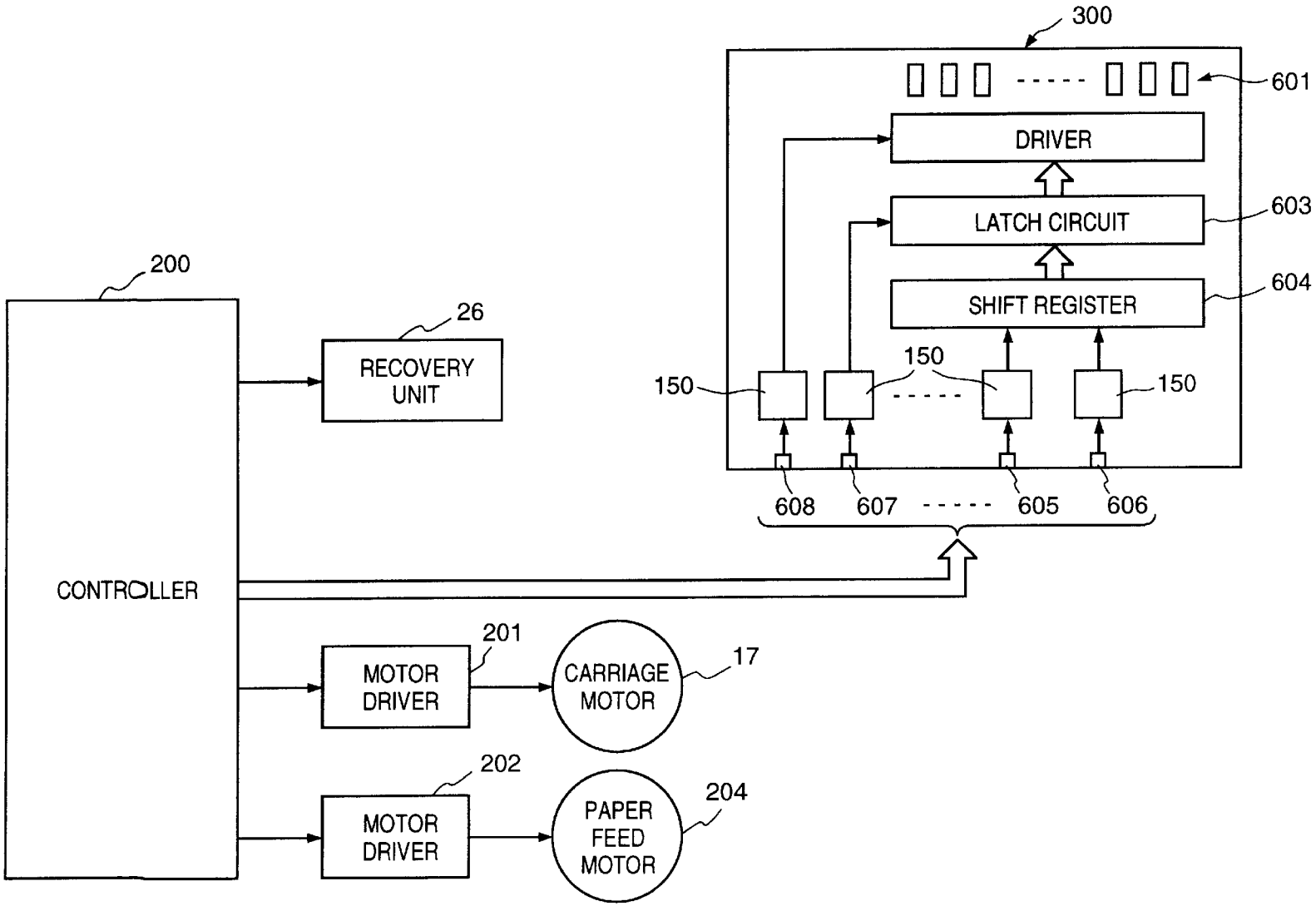
FIG. 13 is a block diagram showing the construction of an ink-jet printing apparatus according to this embodiment of the invention.
Figure 14:
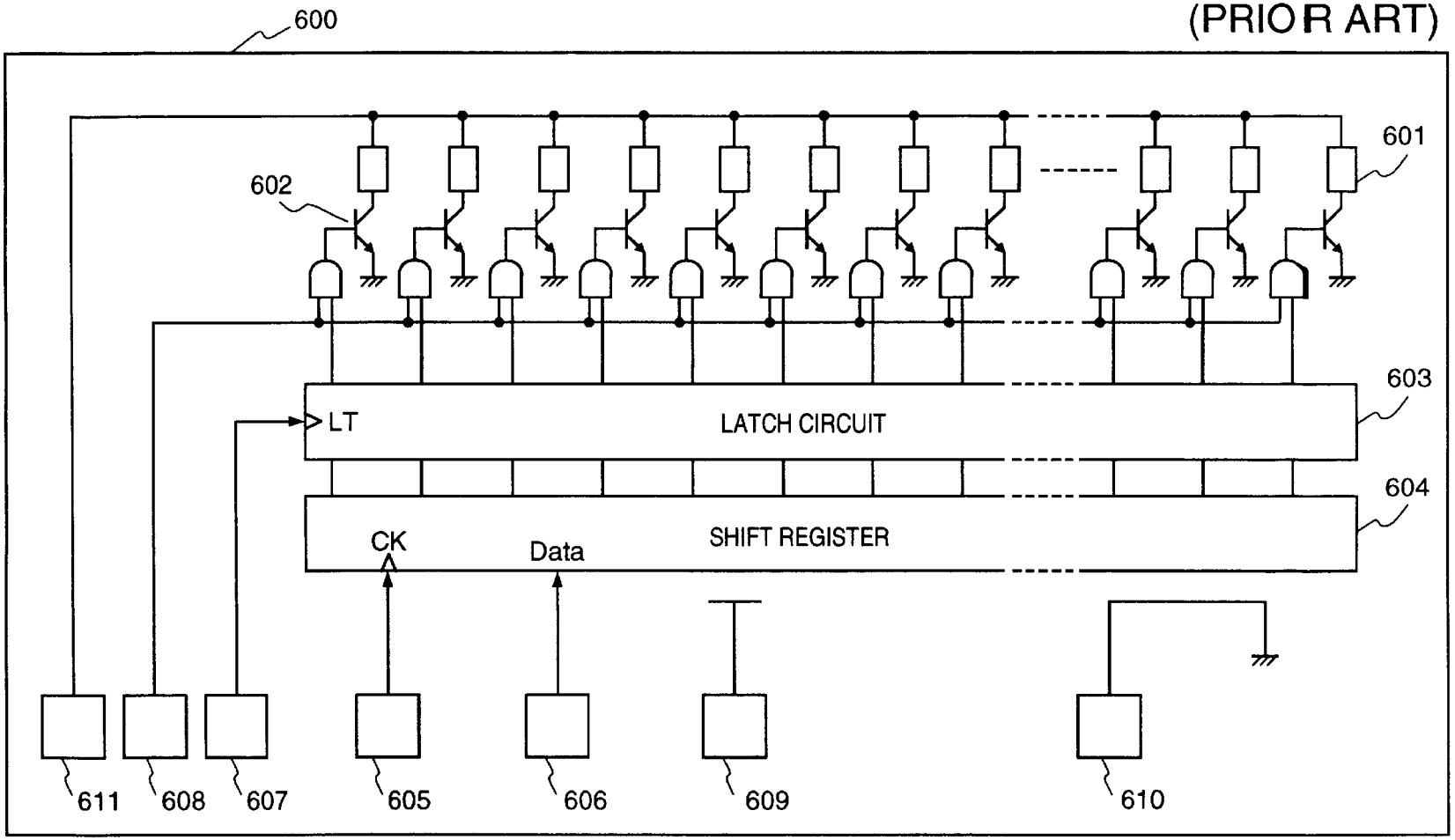
FIG. 14 (PRIOR ART)
FIG. 14 is a diagram showing the construction of a circuit of a printing head according to the prior art.

FIG. 13 is a block diagram showing the basic construction of an ink-jet printing apparatus according to the embodiment shown in FIG. 3. Components identical with those of the above-described embodiment As shown in FIG. 13, the apparatus includes a controller 200 for overall control of the printing apparatus;, motor drivers 201, 202 for rotatively driving a carriage motor 17 and a paper-feed motor 204, respectively, in accordance with signals from the controller 200, and the printing head 300. The latter includes signal input circuits 150, namely circuits of the kind shown in FIG. 1. The other components on the base of the printing head basically are the same as those on the base of the conventional printing head shown in FIG. 5. These components are designated by like reference characters and need not be described again. Numeral 203 denotes in FIG. 12 denotes a signal line on which signals are delivered from the controller 200 to the printing head 300.

In the foregoing description, an example is described in which the base of a printing head is employed in the printing head of an ink-jetting type. However, this does not impose a limitation upon the invention for the base can also be applied to that for a thermal head.

Among the ink-jet printing methods available, the present invention provides outstanding effects especially in printing heads which jet ink by utilizing thermal energy, as well as in printers that use such printing heads.

With regard to a typical configuration and operating principle, it is preferred that the foregoing be achieved using the basic techniques disclosed in the specifications of U.S. Pat. Nos. 4,723,129 and 4,740,796. This scheme is applicable to both so-called on-demand-type and continuous-type apparatus. In the case of the on-demand-type, at least one drive signal, which provides a sudden temperature rise that exceeds that for film boiling, is applied, in accordance with printing information, to an electrothermal transducer arranged to correspond to a sheet or fluid passageway holding a fluid (ink). As a result, thermal energy is produced in the electrothermal transducer to bring about film boiling on the thermal working surface of the printing head. Accordingly, air bubbles can be formed in the fluid (ink) in one-to-one correspondence with the drive signals. Owing to growth and contraction of the air bubbles, the fluid (ink) is jetted via the discharge port so as to form at least one droplet. If the drive signal has the form of a pulse, growth and contraction of the air bubbles can be made to take place rapidly and in appropriate fashion. This is preferred since it will be possible to achieve fluid (ink) jetting having excellent response. Signals described in the specifications of U.S. Pat. Nos. 4,463,359 and 4,345,262 are suitable as drive pulses having this pulse shape. It should be noted that even better recording can be performed by employing the conditions described in the specification of U.S. Pat. No. 4,313,124, which discloses an invention relating to the rate of increase in the temperature of the above-mentioned thermal working surface.

In addition to the combination of the discharge port, fluid passageway and electrothermal transducer (in which the fluid passageway is linear or right-angled) disclosed as the construction of the printing head in each of the above-mentioned specifications, the present invention covers also an arrangement using the art described in the specifications of U.S. Pat. Nos. 4,558,333 and 4,459,600, which disclose elements disposed in an area in which the thermal working portion is curved. Further, it is possible to adopt an arrangement based upon Japanese Patent Application Laid-Open No. 59-123670, which discloses a configuration having a common slit for the ink discharge portions of a plurality of electrothermal transducers, or Japanese Patent Application Laid-Open No. 59-138461, which discloses a configuration having openings made to correspond to the ink discharge portions, wherein the openings absorb pressure waves of thermal energy.

As a printing head of the full-line type having a length corresponding to the maximum width of the recording medium capable of being printed on by the printing apparatus, use can be made of an arrangement in which the length is satisfied by a combination of plural printing heads, or an arrangement in which an individual printing head is formed as an integrated unit. The present invention makes it possible to manifest the foregoing effects to a greater degree.

Further, it is possible to use a freely exchangeable tip-type printing head attached to the main body of the apparatus and capable of being electrically connected to the main body of the apparatus and of supplying ink from the main body, or a cartridge-type printing head in which an ink tank is integrally provided on the printing head itself. The present invention is effective in both cases.

The addition of recovery means for the printing head and spare auxiliary means provided as components of the printing apparatus of the invention is desirable since these stabilize the effects of the invention greatly. Specific examples of these means that can be mentioned are capping means for capping the printing head, cleaning means, pressurizing or suction means, and preheating means such as an electrothermal transducer or another heating element or a combination thereof. Implementing a preliminary ink discharge mode for performing jetting separately of printing also is effective in order to perform stabilized printing.

The printing mode of the printing apparatus is not limited merely to a printing mode for a mainstream color only, such as the color black. The printing head can have a unitary construction or a plurality of printing heads can be combined. It is possible to use an apparatus having at least one printing mode for a plurality of different colors or for full-color printing using mixed colors.

The present invention can be applied to a system constituted by a plurality of devices or to an apparatus comprising a single device. Furthermore, it goes without saying that the invention is applicable also to a case where the object of the invention is attained by supplying a program to a system or apparatus.

Thus, in accordance with the embodiment of the invention as described above, a hysteresis circuit for noise countermeasures can be introduced at an input port to protect erroneous operation caused by a noise signal, and the hysteresis circuit and a pull-up or pull-down resistor serving as fail-safe means in the event of poor contact can be introduced at the input port of a base board of a printing head without interfering with each other. This makes it possible to provide a printing head excelling in noise resistance and safety.

In accordance with the present invention as described above, it is possible to prevent malfunction due a noise component contained in a signal applied to a printing head.

Further, in accordance with the present invention, a circuit having a hysteresis characteristic can be formed ir a simple manner by a MOS-type semiconductor manufacturing process.

Further, in accordance with the invention, it is possible to provide a printing head in which operation of the printing head is not affected even if poor contact results from improper mounting of the head, as well as a printing apparatus which uses this printing head.

As many apparently widely different embodiments of the present invention can be made without departing from the spirit and scope thereof, it is to be understood that the invention is not limited to the specific embodiments thereof except as defined in the appended claims.

What is claimed is:

1. An element base board provided with a plurality of heating elements and circuits for driving said plurality of heating elements in conformity with image data, comprising:

a signal input terminal which is connected to one of a pull-up resistor and a pull-down resistor;

an input-signal processing circuit, having a hysteresis characteristic, provided between said signal input terminal and each of said circuits, the input-signal processing circuit including:

at least two gates having different input threshold values from one another, each of said gates having an output; and a signal-level holding circuit for deciding a level of an output signal in conformity with the outputs of said at least two gates.

2. The element base board according to claim 1, wherein said input-signal processing circuit is integrally formed together with said heating elements and said circuits by a semiconductor manufacturing process.

3. The element base board according to claim 1, wherein each of said circuits includes at least a shift register and a latch circuit.

4. The element base board according to claim 1, wherein the gate of said input-signal processing circuit is constituted by a MOSFET, and said at least two gates have their input threshold values made different by changing a ratio of width to length of the gate constituted by the MOSFET.

5. The element base board according to claim 1, wherein said at least two gates are inverter circuits.

6. The element base board according to claim 1, wherein said signal-level holding circuit includes a flip-flop circuit.

7. A printing head having the element base board according to claim 1.

8. An element base board according to claim 1, wherein said at least two gates include a first gate and a second gate to which a signal from said signal input terminal is applied; and said signal-level holding circuit sets an output signal level in conformity with an output from said first gate and resets the output signal level in conformity with an output from said second gate, and said first gate has an input threshold potential set to be higher than a threshold potential of said second gate.

9. A printing head, comprising:

an element base board, said element base board having;

a plurality of heating elements, a plurality of circuits for driving said plurality of heating elements in conformity with image data, a signal input terminal which is connected to one of a pull-up resistor and a pull-clown resistor, and an input-signal processing circuit having a hysteresis characteristic and provided between said signal input terminal and each of said circuits, the input-signal processing circuit including;

at least two gates having different input threshold values from one another, each of said gates having an output; and a signal level holding circuit for deciding a level of an output signal in conformity with the outputs of said at least two gates.

10. A print head according to claim 9, further comprising:

a plurality of ink discharge ports provided in correspondence to said plurality of heating elements; and ink flow passageways provided in correspondence to said plurality of heating elements.

11. A recording apparatus comprising:

a print head according to claim 9; and means for conveying said print head.

12. An ink jet head, comprising:

an element base board, said element base board having;

a plurality of heating elements, circuits for driving said plurality of heating elements in conformity with image data, a signal input terminal which is connected to one of a pull-up resistor and a pull-down resistor, and an input-signal processing circuit having a hysteresis characteristic and provided between said signal input terminal and each of said circuits, the input signal processing circuit including;

at least two gates having different input threshold values from one another, each of said gates having an output; and a signal level holding circuit for deciding a level of an output signal in conformity with the outputs of said at least two gates; and ink supply passages, each of which is provided in correspondence with each of said plurality of heating elements.

13. The ink jet head according to claim 12, wherein said input-signal processing circuit includes:

at Least two gates having input threshold values that differ from each other; and a signal-level holding circuit for deciding an output signal in conformity with outputs of said at least two gates.

14. The ink jet head according to claim 12, wherein said input-signal processing circuit is integrally formed together with said printing elements and said circuit by a semiconductor manufacturing process.

15. The ink jet head according to claim 12, wherein each of said circuits includes at least a shift register and a latch circuit.

16. The ink jet head according to claim 12, wherein said signal input terminals of said input-signal processing circuit are connected to either pull-up resistors or pull-down resistors.

17. The ink jet head according to claim 12, wherein the gate of said input-signal processing circuit is constituted by a MOSFET, and said at least two gates have their input threshold values made different by changing a ratio of width to length of the gate constituted by the MOSFET.

18. The ink jet head according to claim 12, wherein said at least two gates are inverter circuits.

19. The ink jet head according to claim 12, wherein said signal-level holding circuit is flip-flop.

20. An ink cartridge, comprising:

said ink jet head according to claim 12; and ink container for accommodating ink to be supplied to said ink jet head.

21. An ink jet apparatus, comprising:

said ink jet head according to claim 12;

carrying means for carrying said ink jet head; and signal supply means for supplying signals to said element base board.

22. An ink jet apparatus, comprising:

said ink jet head according to claim 12;

carrying means for carrying said ink jet head; and conveying means for conveying a printing medium.

23. The element base board according to claim 7, wherein said signal-level holding circuit includes a flip-flop circuit constructed by at least 2 gates.

24. A printing apparatus for printing on a recording medium by passing a current into a printing head in conformity with a print signal, comprising:

a printing head having an element base board provided with a plurality of heating elements and circuits for driving said plurality of heating elements in conformity with image data, wherein said base board includes a signal input terminal which is connected to one of a pull-up resistor and a pull-down resistor, and an input-signal processing circuit, having a hysteresis characteristic, provided between said signal input terminal and said input-signal processing circuit, the input processing circuit including;

at least two gates having different input threshold values from one another, each of said gates having an output; and a signal level holding circuit for deciding a level of an output signal in conformity with the outputs of said at least two gates; and printing means for performing printing by outputting the print signal to said printing head and driving said plurality of heating elements in conformity with the image data.

25. The apparatus according to claim 24, wherein said input-signal processing circuit includes:

at least two gates having input threshold values that differ from each other; and a signal-level holding circuit for deciding an output signal in conformity with outputs of said at least two gates.

26. The apparatus according to claim 24, wherein said input-signal processing circuit is integrally formed together with said printing elements and said circuits by a semiconductor manufacturing process.

27. The apparatus according to claim 24, wherein each of said circuits includes at least a shift register and a latch circuit.

28. The apparatus according to claim 24, wherein said signal input terminal is connected to either a pull-up resistor or a pull-down resistor.

29. The apparatus according to claim 24, wherein the gate of said input-signal processing circuit is constituted by a MOSFET, and said at least two gates have their input threshold values made different by changing a ratio of width to length of the gate constitutes by the MOSFET.

30. The apparatus according to claim 24, wherein said printing head is a head for ink-jet printing.

31. An element base having a plurality of heating elements and drive circuits for driving the plurality of heating elements in accordance with image data, comprising:

a plurality of signal input terminals; and input-signal processing circuits including;

a pull-up circuit or pull-down circuit connected to each of the signal input terminals; and a hysteresis characteristic circuit with high input impedance, provided between said pull-up circuit or pull-clown circuit and each of said drive circuits.

32. An element base according to claim 31, wherein said hysteresis characteristic circuit is made by MOSFET.

33. An element base board according to claim 31, wherein said input-signal processing circuit includes:

at least two gates having input threshold values that differ from each other; and a signal-level holding circuit for deciding an output signal in conformity with outputs of said at least two gates.

34. An element base board according to claim 31, wherein said input-signal processing circuit is integrally formed together with said heating elements and said drive circuits by a semiconductor manufacturing process.

35. An element base board according to claim 31, wherein each of said drive circuits includes at least a shift register and a latch circuit.

36. An element base board according to claim 33, wherein the gate of said input-signal processing circuit is constituted by a MOSFET, and said at least two gates have their input threshold values made different by changing a ratio of width to length of the gate constituted by the MOSFET.

37. An element base board according to claim 33, wherein said at least two gates are inverter circuits.

38. An element base board according to claim 33, wherein said signal-level holding circuit is a flip-flop.

39. A print head having an element base board according to claim 31.

40. A print head according to claim 39, further comprising:

a plurality of ink discharge ports provided in correspondence to said plurality of heating elements; and ink flow passageways provided in correspondence to said plurality of heating elements.

41. A recording apparatus comprising: a print head according to claim 39; and means for conveying said print head.

* * * * *

UNITED STATES PATENT AND TRADEMARK OFFICE

CERTIFICATE OF CORRECTION

PATENT NO. : 6,054,689

DATED : April 25, 2000

INVENTOR(S) : YOSHIYUKI IMANAKA ET AL.

It is certified that error appears in the above-identified patent and that said Letters Patent is hereby corrected as shown below:

ON THE COVER PAGE AT [56] REFERENCES CITED, FOREIGN PATENT DOCUMENTS

"2843064 4/1979 United Kingdom" should read --2843604 4/1979 Germany--.

ON COVER PAGE AT [57] ABSTRACT

Line 3, "are" should read --is--.

COLUMN 1

Line 58, "605 611," should read --605-611,--.

COLUMN 2

Line 12, "Element 601" should read --element 601--;
Line 20, "Lines" should read --lines--;
Line 36, "dne a" should read --due to a--;
Line 53, "even" should read --even when--.

COLUMN 4

Line 10, "ink–et" should read --ink-jet--;
Line 30, "raking" should read --making--.

UNITED STATES PATENT AND TRADEMARK OFFICE

CERTIFICATE OF CORRECTION

PATENT NO. : 6,054,689

DATED : April 25, 2000

INVENTOR(S) : YOSHIYUKI IMANAKA ET AL.

It is certified that error appears in the above-identified patent and that said Letters Patent is hereby corrected as shown below:

COLUMN 5

Line 2, "construction a" should read --construction of a--;
Line 33, "are" should read --is--;
Line 56, "interfere" should read --interference--.

COLUMN 8

Line 40, "apparatus;," should read --apparatus,--;
Line 49, "denotes" should be deleted.

COLUMN 10

Line 23, "due a" should read --due to a--;
Line 26, "ir" should read --in--.

COLUMN 11

Line 63, "Least" should read --least--.

COLUMN 12

Line 3, "circuit" should read --circuits--.

UNITED STATES PATENT AND TRADEMARK OFFICE

CERTIFICATE OF CORRECTION

PATENT NO. : 6,054,689

DATED : April 25, 2000

INVENTOR(S) : YOSHIYUKI IMANAKA ET AL.

It is certified that error appears in the above-identified patent and that said Letters Patent is hereby corrected as shown below:

COLUMN 13

Line 15, "constitutes" should read --constituted--;
Line 27, "pull-clown" should read --pull-down--.

Signed and Sealed this

Fifteenth Day of May, 2001

Nicholas P. Godici

*Attest:*

NICHOLAS P. GODICI

*Attesting Officer*

*Acting Director of the United States Patent and Trademark Office*